US011028724B2

(12) United States Patent
Shin et al.

(10) Patent No.: US 11,028,724 B2
(45) Date of Patent: Jun. 8, 2021

(54) PARTIAL ADMISSION OPERATION TURBINE APPARATUS FOR IMPROVING EFFICIENCY OF CONTINUOUS PARTIAL ADMISSION OPERATION AND METHOD FOR OPERATING TURBINE APPARATUS USING SAME

(71) Applicant: KOREA INSTITUTE OF ENERGY RESEARCH, Daejeon (KR)

(72) Inventors: Hyung Ki Shin, Sejong-si (KR); Jun Hyun Cho, Sejong-si (KR); Young Jin Baik, Daejeon (KR); Gil Bong Lee, Daejeon (KR); Beom Joon Lee, Sejong-si (KR); Chui Woo Roh, Sejong-si (KR); Ho Sang Ra, Daejeon (KR); Jong Jae Cho, Sejong-si (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 139 days.

(21) Appl. No.: 16/469,941

(22) PCT Filed: Nov. 1, 2017

(86) PCT No.: PCT/KR2017/012263
§ 371 (c)(1),
(2) Date: Jun. 14, 2019

(87) PCT Pub. No.: WO2018/110827
PCT Pub. Date: Jun. 21, 2018

(65) Prior Publication Data

US 2020/0095885 A1 Mar. 26, 2020

(30) Foreign Application Priority Data

Dec. 15, 2016 (KR) ..... 10-2016-0171395

(51) Int. Cl.
*F01D 17/10* (2006.01)
*F01D 17/18* (2006.01)

(52) U.S. Cl.
CPC ..... *F01D 17/105* (2013.01); *F01D 17/18* (2013.01)

(58) Field of Classification Search
CPC ..... F01D 17/105; F01D 17/18; F01D 17/14; F01D 17/141; F02C 1/00
See application file for complete search history.

(56) References Cited

U.S. PATENT DOCUMENTS 4,780,057 A * 10/1988 Silvestri, Jr. ..... F01D 17/18 415/202
5,269,648 A * 12/1993 Freuschle ..... F01D 17/141 415/148

(Continued)

FOREIGN PATENT DOCUMENTS

JP 2014-20320 A 2/2014
KR 10-2012-0064843 A 6/2012

(Continued)

*Primary Examiner* — Richard A Edgar
*Assistant Examiner* — Jackson N Gillenwaters
(74) *Attorney, Agent, or Firm* — Birch, Stewart, Kolasch & Birch, LLP

(57) ABSTRACT

The present invention provides a partial admission operation turbine apparatus comprising: a rotor portion rotatably coupled to a rotary shaft of a turbine and including a plurality of rotor blades; a nozzle portion fixedly coupled to the rotary shaft in front of the rotor portion and guiding and supplying a working fluid to the rotor blades through a plurality of nozzle blades; and an inlet disk coupled to the rotary shaft in front of the nozzle portion in a plate shape and having a plurality of admission holes formed therein so as to supply the working fluid to the nozzle portion to partially admit the working fluid into the nozzle portion, wherein each of the admission holes is formed to have a different (Continued)

passage cross-sectional areas, so that the opening and closing of the admission holes are controlled according to operating flow rate conditions to control a partial admission ratio of the working fluid supplied to the nozzle portion. Due to the aforementioned feature, since continuous partial admission can be operated for a supercritical power generation system, it is possible to resolve the difficulties in designing and manufacturing turbines. Also, since the partial admission ratio can be adjusted according to operating conditions, it is possible to improve the performance of a turbine that is operated by continuous partial admission. Furthermore, even if the operating flow rate conditions change in the same cycle, it is possible to operate the same turbine with high efficiency.

14 Claims, 4 Drawing Sheets

(56) References Cited

U.S. PATENT DOCUMENTS

| | | | | |
|---|---|---|---|---|
| 5,487,643 | A * | 1/1996 | Pearson | F01D 9/00 415/208.1 |
| 8,739,539 | B2 * | 6/2014 | Tecza | F01D 9/041 60/670 |
| 8,806,874 | B2 * | 8/2014 | Onoda | F01D 13/00 60/806 |
| 8,821,105 | B2 * | 9/2014 | Ooyama | F02M 35/10222 415/1 |
| 2010/0050963 | A1 | 3/2010 | Ooyama | |
| 2014/0020391 | A1 | 1/2014 | Onoda et al. | |

FOREIGN PATENT DOCUMENTS

| | | | |
|---|---|---|---|
| KR | 101178322 | B1 * | 8/2012 |
| KR | 10-1669519 | B1 | 10/2016 |
| WO | WO 2008/020619 | A1 | 2/2008 |

* cited by examiner (a)

(b)

PARTIAL ADMISSION OPERATION TURBINE APPARATUS FOR IMPROVING EFFICIENCY OF CONTINUOUS PARTIAL ADMISSION OPERATION AND METHOD FOR OPERATING TURBINE APPARATUS USING SAME

CROSS REFERENCE TO RELATED APPLICATIONS

This application is the National Phase of PCT International Application No. PCT/KR2017/012263, filed on Nov. 1, 2017, which claims priority under 35 U.S.C. 119(a) to Patent Application No. 10-2016-0171395, filed in the Republic of Korea on Dec. 15, 2016, all of which are hereby expressly incorporated by reference into the present application.

TECHNICAL FIELD

The present invention relates to a partial admission operation turbine apparatus, and more particularly, to a partial admission operation turbine apparatus for improving efficiency of a continuous partial admission operation in which a continuous partial admission operation is performed by using supercritical carbon dioxide ($SCO_2$) as a working fluid so that the performance and efficiency of a turbine can be improved, and a method for operating the turbine apparatus using the same.

BACKGROUND ART

In general, supercritical carbon dioxide ($CO_2$) power generation cycle technologies are high-efficiency power generation cycle technologies in which $CO_2$ compressed under a super-high pressure higher than a critical pressure is heated at a high temperature so as to drive a turbine, and recently, power generation technologies in which $CO_2$ of which supercritical conversion to a low critical point is easy and which has high density and low viscosity in a supercritical state, is used as a working fluid, have been developed.

Meanwhile, because in such supercritical power generation cycle technologies, a compression work can be significantly reduced compared to an existing air cycle, and the size of a turbine can be reduced to ⅕ of an organic rankine cycle (ORC) and equal to or less than 1/20 of a steam cycle, a turbo apparatus can be made small, and a thermal recovery temperature is fallen so that water at a room temperature can be used as a coolant, and the supercritical power generation cycle technologies can be applied to most heat sources such as waste heat recovery/independent heat sources, such as coal or CPS. Also, in the aforementioned supercritical power generation system, compatibility between $CO_2$ and an existing fluid is excellent even under high-temperature high-pressure conditions so that a higher turbine inlet temperature can be achieved than in a steam cycle and efficiency can be improved, and $CO_2$ that is a main cause of global warming can be reversedly utilized as the working fluid so that an eco-friendly power generation plant can be constructed.

However, in the aforementioned supercritical dioxide ($SCO_2$) cycle and ORC cycle, unlike in the existing steam rankine cycle or air Brayton cycle, due to high density or small heat source calories, the size of the turbine is reduced. Thus, when designs are carried out like the existing steam turbine or gas turbine, due to significantly reduced sizes, it is not possible to manufacture the turbine, or tolerance maintenance is not possible.

DETAILED DESCRIPTION OF THE INVENTION

Technical Problem

The present invention provides a partial admission operation turbine apparatus in which a continuous partial admission (not full admission) operation can be performed for a turbine in a supercritical carbon dioxide ($SCO_2$) cycle and an organic rankine cycle (ORC) so that the difficulties in designing and manufacturing turbines can be resolved and the performance of the turbine can be improved, and a method for operating a turbine apparatus using the same.

Technical Solution

According to an aspect of the present invention, there is provided a partial admission operation turbine apparatus including a rotor portion rotatably coupled to a rotary shaft of a turbine and including a plurality of rotor blades, a nozzle portion fixedly coupled to the rotary shaft in front of the rotor portion and guiding and supplying a working fluid to the rotor blades through a plurality of nozzle blades, and an inlet disk coupled to the rotary shaft in front of the nozzle portion in a plate shape and having a plurality of admission holes formed therein so as to supply the working fluid to the nozzle portion to partially admit the working fluid into the nozzle portion, wherein each of the admission holes is formed to have at least two different passage cross-sectional areas, so that the opening and closing of the admission holes are controlled according to operating flow rate conditions to control a partial admission ratio of the working fluid supplied to the nozzle portion.

According to another aspect of the present invention, there is provided a method for operating a partial admission operation turbine apparatus, the method including being ready for operation of a partial admission operation turbine apparatus including a rotor portion rotatably coupled to a rotary shaft of a turbine and including a plurality of rotor blades, a nozzle portion fixedly coupled to the rotary shaft in front of the rotor portion and guiding and supplying a working fluid to the rotor blades through a plurality of nozzle blades, and an inlet disk coupled to the rotary shaft in front of the nozzle portion in a plate shape and having a plurality of admission holes formed therein so as to supply the working fluid to the nozzle portion to partially admit the working fluid into the nozzle portion, wherein each of the admission holes is formed to have at least two different passage cross-sectional areas, and controlling a partial admission ratio of the working fluid supplied to the nozzle portion by opening and closing the admission holes according to set operating flow rate conditions.

Effects of the Invention

A partial admission operation turbine apparatus for improving the efficiency of a continuous partial admission operation and a method for operating the turbine apparatus using the same according to the present invention provide the following effects.

First, a continuous partial admission operation is performed in a supercritical carbon dioxide ($SCO_2$) cycle and an organic rankine cycle (ORC) and a supercritical power generation system so that the difficulties in designing and manufacturing turbines can be resolved.

Second, a plurality of admission holes having different passage cross-sectional areas are formed so that a partial admission ratio can be controlled according to operating conditions, the performance of a turbine operated by continuous partial admission can be improved, and even if the operating flow rate conditions change in the same cycle, it is possible to operate the same turbine with high efficiency.

Third, the shapes of nozzle blades are differently formed for each of the admission holes having different passage cross-sectional areas so that passage flow rates can be controlled and thus the efficiency of the turbine apparatus can be improved.

Fourth, the shapes of nozzles and rotors having high costs in developing and manufacturing are fixed to one shape, and only the area of an inlet is differently formed so that one turbine can be used for various capacities and thus costs can be reduced.

MODE OF THE INVENTION

Hereinafter, exemplary embodiments of the present invention will be described in detail with reference to the accompanying drawings.

Figure 1:
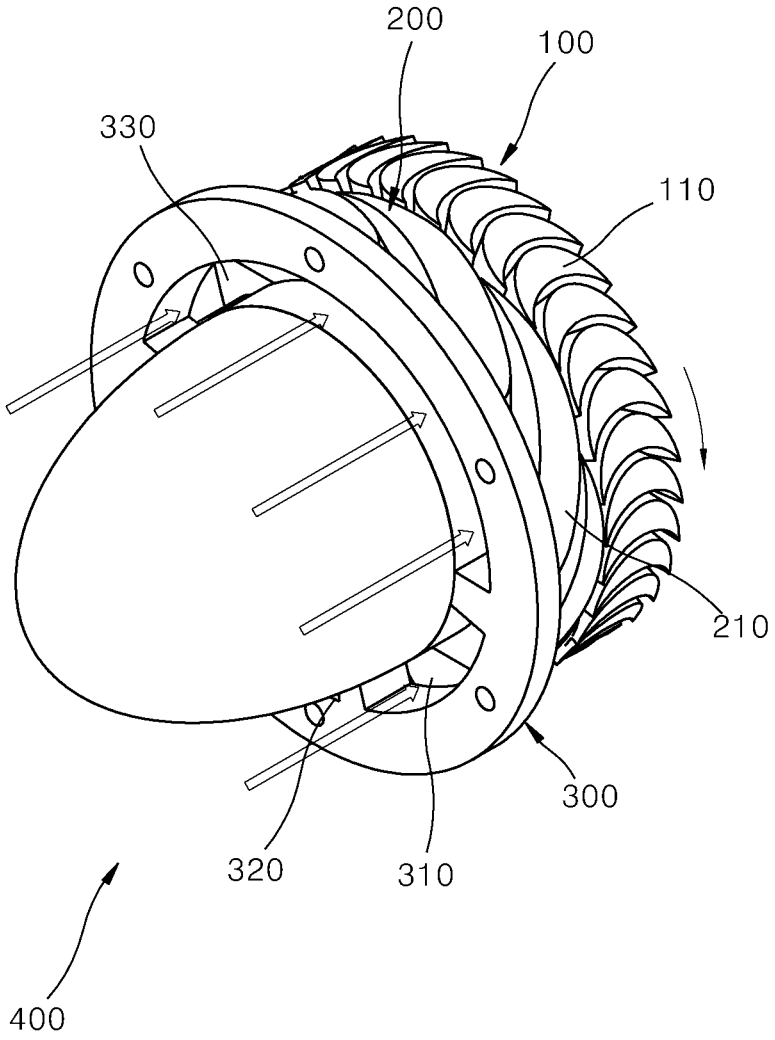
FIG. 1 is a perspective view illustrating a partial admission turbine apparatus according to an embodiment of the present invention.

Referring to FIG. 1, a partial admission operation turbine apparatus 400 according to an embodiment of the present invention in which the efficiency of a continuous partial admission operation can be improved and a continuous partial admission (not full admission) operation is performed by using a working fluid in a supercritical state, in particular, supercritical carbon dioxide ($SCO_2$, including gas or steam) as the working fluid so that the performance and efficiency of the turbine can be improved, includes a rotor portion 100, a nozzle portion 200, and an inlet disk 300.

The rotor portion 100 is rotatably coupled to a rotary shaft (not shown) installed within a casing (not shown), includes a plurality of rotor blades (buckets) 110 and is rotated by an introduced working fluid.

The nozzle portion 200 is fixedly coupled to the rotary shaft in front of the rotor portion 100 and includes a plurality of nozzle blades 210, allows the working fluid to flow between the nozzle blades 210, guides and supplies the working fluid to the rotor blades 110. Here, the rotor portion 100 and the nozzle portion 200 correspond to configurations of a nozzle (stator) and a rotor (bucket) of well-known turbine, respectively, and thus a detailed description thereof will be omitted.

The inlet disk 300 has a plate shape, is coupled to the rotary shaft in front of the nozzle portion 200 and has a plurality of admission holes 310, 320, and 330 for supplying the working fluid to the nozzle portion 200 formed therein so that the working fluid can be partially admitted into the nozzle portion 200 through the admission holes 310, 320, and 330.

Figure 2:
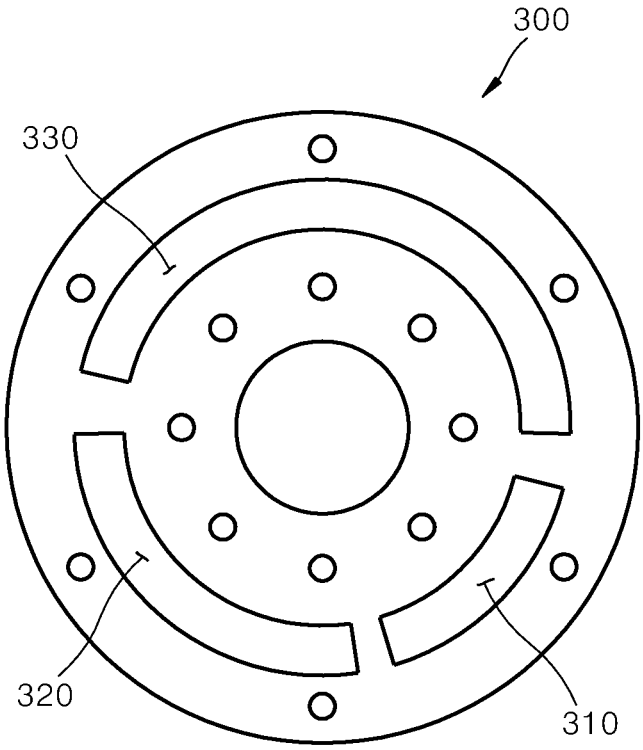
FIG. 2 is a front view illustrating an inlet disk of the partial admission turbine apparatus of FIG. 1.

Referring to FIG. 2, the admission holes 310, 320, and 330 are formed to have at least two different passage cross-sectional areas so that opening and closing of the admission holes 310, 320, and 330 are optionally controlled according to operating flow rate conditions and thus a partial admission ratio of the working fluid supplied to the nozzle portion 200 can be controlled.

Thus, the partial admission operation turbine apparatus 400 enables an operation with high efficiency with the same turbine even if the operating flow rate conditions change in the same cycle, and the shapes of the nozzle blades 210 and the rotor blades 110 having high costs in developing and manufacturing are fixed to one shape, and only the passage cross-sectional areas of the admission holes 310, 320, and 330 into which the working fluid is introduced, are differently formed so that one turbine can be used for various capacities and thus costs can be reduced.

Here, the inlet disk 300 includes three admission holes 310, 320, and 330 having different passage cross-sectional areas formed therein in the drawings. However, this is just an embodiment, and of course, the number of admission holes may be diverse according to designs.

Meanwhile, the nozzle blades 210 may form differently a flow path passage area of the working fluid that flows between the nozzle blades 210 in response to at least two different passage cross-sectional areas of the admission holes 310, 320, and 330 so that efficiency can be improved in response to the passage cross-sectional areas of the admission holes 310, 320, and 330.

Figure 3:
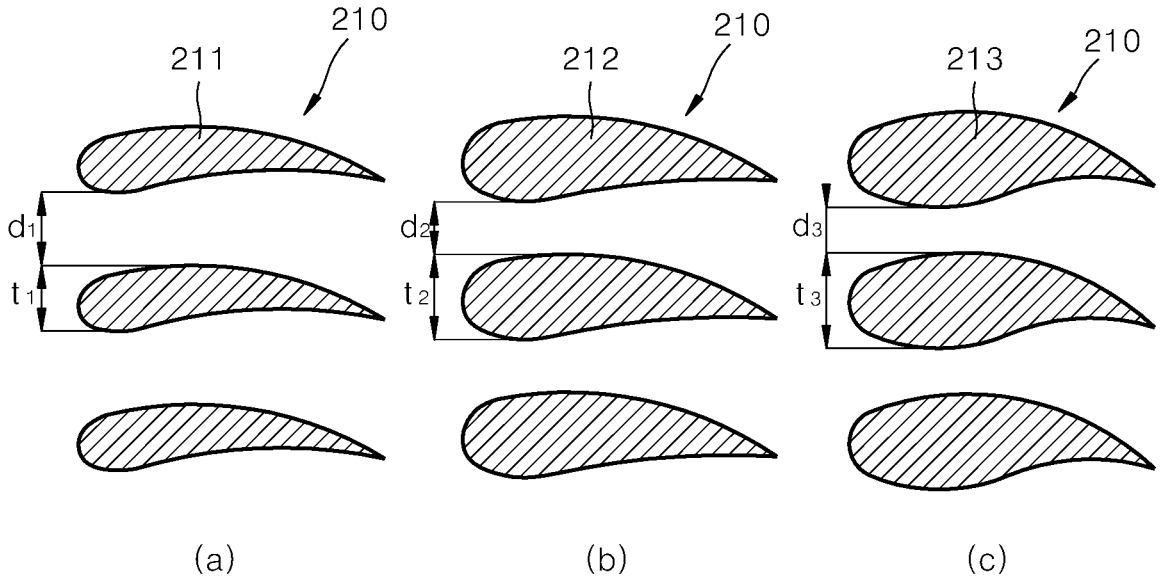
FIG. 3 is a view illustrating the shapes of nozzle blades of a nozzle portion of FIG. 1.

To this end, the nozzle blades 210 form differently thickness ratios/chord lengths in response to at least two different passage cross-sectional areas of the admission holes 310, 320, and 330, as shown in FIG. 3, so that separation distances (pitches) d1, d2, and d3 between the adjacent nozzle blades 210 are differently formed and thus the flow path passage area of the working fluid that passes between the nozzle blades 210 can be differently formed.

Regarding this in detail, in the nozzle blades 210, the smaller the passage cross-sectional areas of the admission holes 310, 320, and 330, the shorter the separation distances between the nozzle blades 210, and the larger the passage cross-sectional areas of the admission holes 310, 320, and 330, the longer the separation distances between the nozzle blades 210 so that the flow path passage area can be increased and a flow rate can be obtained.

Regarding this in detail by referring to FIG. 3, (a) of FIG. 3 illustrates nozzle blades 211 that correspond to admission holes 330 having the largest passage cross-sectional area in FIG. 2, and the thickness ratio t1 of the nozzle blades 211 is reduced so that a separation distance d1 between the nozzle blades 211 is increased and thus, the flow path passage area can be increased, and conversely, regarding admission holes 310 having the smallest passage cross-sectional area, as shown in (c) of FIG. 3, the thickness ratio t3 of nozzle blades 213 is increased and thus, a separation distance d2 between the nozzle blades 213 can be decreased and thus, the flow path passage area can be decreased. (b) of FIG. 3 illustrates nozzle blades 212 that correspond to admission holes 320 of FIG. 2, and the thickness ratio is larger than that of (a) of FIG. 3 and is smaller than that of (c) of FIG. 3, and d2 represents a separation distance, and t1 represents a thickness.

Meanwhile, the nozzle blades 210 are formed so that separation distances between the nozzle blades 210 are decreased as the passage cross-sectional areas of the admission holes 310, 320, and 330 are decreased and separation distances between the nozzle blades 210 are increased as the passage cross-sectional areas of the admission holes 310, 320, and 330 are increased. However, this is just an exemplary embodiment, and of course, there may be various modifications according to designs, where, as the passage cross-sectional areas of the admission holes 310, 320, and 330 are decreased, the thickness ratio of the nozzle blades 210 are decreased so that the flow path passage area of the nozzle portion 200 can be obtained.

In the partial admission operation turbine apparatus 400, in order to control a partial admission ratio of the working fluid by optionally controlling the opening and closing of the admission holes 310, 320, and 330 according to operating flow rate conditions, although not shown, a control disk having the same flat surface shape as that of the inlet disk 300, having control holes formed therein and being rotatable may be installed at a rear surface of the inlet disk 300, and the control disk may be rotated to optionally open and close the admission holes 310, 320, and 330 or the flow path passage area may be changed.

Furthermore, the partial admission operation turbine apparatus 400 may include a flow rate control unit (not shown) so as to control a partial admission ratio of the working fluid supplied to the nozzle portion 200, thereby controlling the supply flow rate of the working fluid in response to the passage cross-sectional areas of the admission holes 310, 320, and 330.

The flow rate control unit includes a plurality of supply lines for supplying the working fluid according to positions of the admission holes 310, 320, and 330, a plurality of flow rate control valves installed in the plurality of supply lines, and a controller for controlling the operation of the flow rate control valves in response to the admission holes 310, 320, and 330.

In this case, the controller controls the operation of the flow rate control valves in response to the passage cross-sectional areas of the admission holes 310, 320, and 330 according to operating conditions and cycle designs and controls the supply flow rate of the working fluid so as to control the partial admission ratio of the working fluid.

As described above, a method for operating a turbine apparatus using the partial admission operation turbine apparatus 400 includes being ready for operation of the partial admission operation turbine apparatus 400, opening and closing the admission holes 310, 320, and 330 according to set operating flow rate conditions so as to control the partial admission ratio of the working fluid supplied to the nozzle portion 200, wherein the making of the partial admission operation turbine apparatus 400 being ready for operation includes differently forming separation distances between the nozzle blades in response to the passage cross-sectional areas of the opened admission holes 310, 320, and 330 so as to control the supply flow rate. In this case, in the nozzle blades 210, preferably, the smaller the passage cross-sectional areas of the admission holes 310, 320, and 330, the shorter the separation distances between the nozzle blades 210. Furthermore, by using the flow rate control unit, the controller controls the operation of the flow rate control valves in response to the passage cross-sectional areas of the admission holes 310, 320, and 330 so that the supply flow rate of the working fluid can be controlled.

Figure 4:
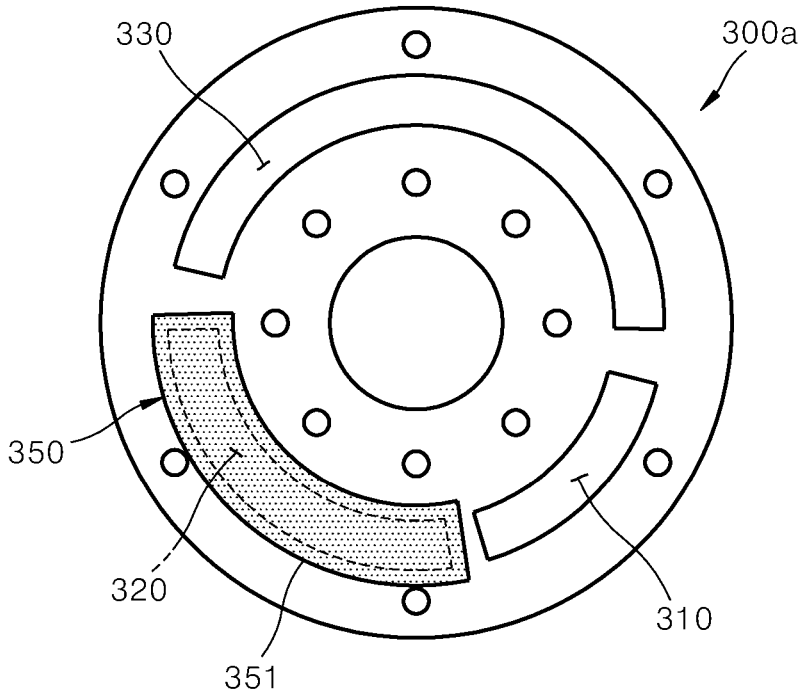
FIG. 4 is a front view illustrating a partial admission turbine apparatus according to another embodiment of the present invention.
Figure 4:
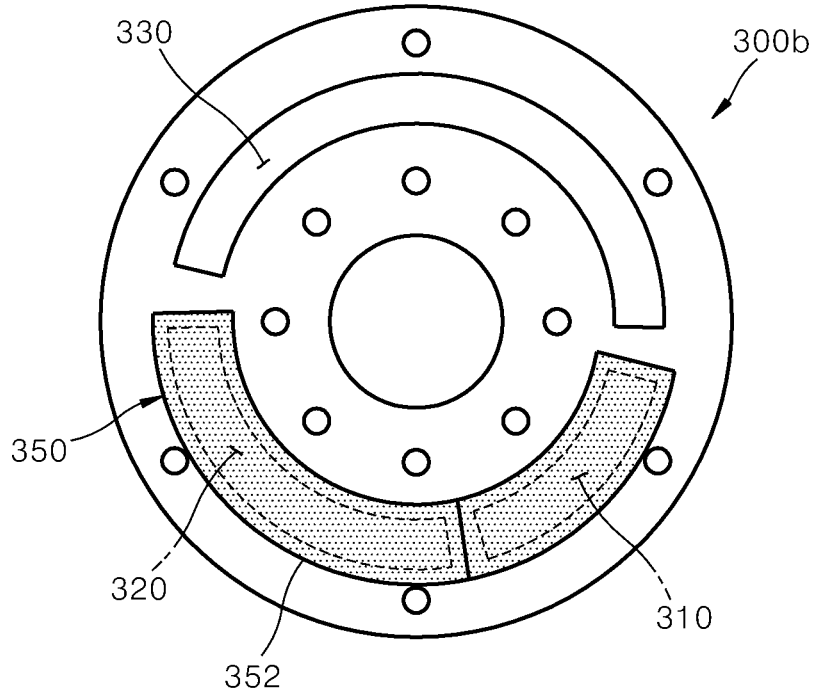

FIG. 4 illustrates a partial admission operation turbine apparatus according to another embodiment of the present invention. Referring to FIG. 4, the partial admission operation turbine apparatus includes inlet disks 300*a* and 300*b*, which may be optionally installed at an inlet of a turbine to be mounted and have a plurality of admission holes 310, 320 and 330 formed therein so that the working fluid can be partially admitted into the nozzle portion, and an opening/closing unit 350 that optionally opens and closes the admission holes 310, 320, and 330 according to designs.

The inlet disks 300*a* and 300*b* have plate shapes and include a plurality of admission holes 310, 320, and 330 formed therein so as to supply the working fluid to the nozzle portion of the turbine, and the plurality of admission holes 310, 320, and 330 are formed to have at least two different passage cross-sectional areas so that the working fluid can be partially admitted into the nozzle portion.

The opening/closing unit 350 opens or closes the plurality of admission holes 310, 320, and 330 optionally according to a turbine to be installed and a turbine to be mounted, including the flow rate of the working fluid. The opening/closing unit 350 has a plate shape and includes opening/closing covers 351 and 352, which are coupled to the front surfaces or rear surfaces of the inlet disks 300*a* and 300*b* corresponding to the admission holes 310, 320, and 330. Here, although not shown, the opening/closing covers 351 and 352 may be coupled to the inlet disks 300*a* and 300*b* by using various methods such as bolt fastening, welding, or the like, and a well-known coupling method may be applied to a detailed description thereof and thus, the detailed description thereof will be omitted.

In the drawings, (a) and (b) of figure respectively illustrate cases where the admission holes 310, 320, and 30 are optionally closed using the opening/closing covers 351 and 352, and (a) illustrates the case where the flow rate of the working fluid is larger than that of (b) or the opened inlet area of the admission holes 310, 320, and 330 are increased in consideration of designs, etc.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, a turbine that can be operated through continuous partial admission can be designed and manufactured.

The invention claimed is:

1. A partial admission operation turbine apparatus comprising:

a rotor portion rotatably coupled to a rotary shaft of a turbine and including a plurality of rotor blades;

a nozzle portion disposed in front of the rotor portion and guiding and supplying a working fluid to the rotor blades through a plurality of nozzle blades; and an inlet disk disposed in front of the nozzle portion in a plate shape and having a plurality of admission holes formed therein so as to supply the working fluid to the nozzle portion to partially admit the working fluid into the nozzle portion, wherein each of the admission holes is formed to have at least two different passage cross-sectional areas, so that the opening and closing of the admission holes are controlled according to operating flow rate conditions to control a partial admission ratio of the working fluid supplied to the nozzle portion, and wherein the plurality of nozzle blades form differently a flow path passage area of the working fluid that flows between the nozzle blades due to the different passage cross-sectional areas of the admission holes.

2. The partial admission operation turbine apparatus of claim 1, wherein the partial admission operation turbine apparatus includes different separation distances between the nozzle blades due to the different passage cross-sectional areas of the admission holes.

3. The partial admission operation turbine apparatus of claim 2, wherein, in the nozzle blades, the smaller the passage cross-sectional areas of the admission holes, the shorter the separation distances between the nozzle blades.

4. The partial admission operation turbine apparatus of claim 3, wherein the nozzle blades form differently thickness ratios due to the admission holes so as to form differently the separation distances between the adjacent nozzle blades.

5. The partial admission operation turbine apparatus of claim 2, wherein the nozzle blades form differently thickness ratios due to the admission holes so as to form differently the separation distances between the adjacent nozzle blades.

6. The partial admission operation turbine apparatus of claim 1, further comprising a flow rate control unit controlling a supply flow rate of the working fluid in response to the passage cross-sectional areas of the admission holes.

7. The partial admission operation turbine apparatus of claim 6, wherein the flow rate control unit comprises: a plurality of supply lines supplying the working fluid; and a plurality of flow rate control valves respectively installed in the plurality of supply lines.

8. The partial admission operation turbine apparatus of claim 1, wherein the working fluid is in a supercritical state.

9. The partial admission operation turbine apparatus of claim 1, wherein the working fluid is supercritical carbon dioxide ($CO_2$).

10. The partial admission operation turbine apparatus of claim 1, further comprising an opening/closing unit coupled to the inlet disk and opening or closing the plurality of admission holes.

11. The partial admission operation turbine apparatus of claim 10, wherein the opening/closing unit comprises opening/closing covers coupled to a front surface or rear surface of the inlet disk corresponding to the admission holes, the opening/closing unit having a plate shape.

12. A method for operating a partial admission operation turbine apparatus, the method comprising:

assembling a partial admission operation turbine apparatus including:

rotatably coupling a rotor portion to a rotary shaft of a turbine, the rotor portion including a plurality of rotor blades;

providing a nozzle portion disposed in front of the rotor portion and guiding and supplying a working fluid to the rotor blades through a plurality of nozzle blades; and providing an inlet disk disposed in front of the nozzle portion in a plate shape and forming a plurality of admission holes so as to supply the working fluid to the nozzle portion to partially admit the working fluid into the nozzle portion, wherein each of the admission holes is formed to have at least two different passage cross-sectional areas; and controlling a partial admission ratio of the working fluid supplied to the nozzle portion by opening and closing the admission holes according to set operating flow rate conditions, wherein the assembling of the partial admission operation turbine apparatus further comprises differently forming separation distances between the nozzle blades due to the passage cross-sectional areas of the opened admission holes.

13. The method of claim 12, wherein the partial admission operation turbine apparatus further comprises a flow rate control unit including a plurality of supply lines supplying the working fluid, a plurality of flow rate control valves respectively installed in the plurality of supply lines, and a controller controlling an operation of the plurality of flow rate control valves, and the controller controls a supply flow rate of the working fluid by controlling an operation of the flow rate control valves according to the passage cross-sectional areas of the admission holes.

14. A method for operating a partial admission operation turbine apparatus, the method comprising:

assembling a partial admission operation turbine apparatus including:

rotatably coupling a rotor portion to a rotary shaft of a turbine, the rotor portion including a plurality of rotor blades;

providing a nozzle portion disposed in front of the rotor portion and guiding and supplying a working fluid to the rotor blades through a plurality of nozzle blades; and providing an inlet disk disposed in front of the nozzle portion in a plate shape and forming a plurality of admission holes so as to supply the working fluid to the nozzle portion to partially admit the working fluid into the nozzle portion, wherein each of the admission holes is formed to have at least two different passage cross-sectional areas; and controlling a partial admission ratio of the working fluid supplied to the nozzle portion by opening and closing the admission holes according to set operating flow rate conditions, wherein, in the nozzle blades, the smaller the passage cross-sectional areas of the admission holes, the shorter the separation distances between the nozzle blades.

* * * * *